US010761477B2

(12) United States Patent
Ohta et al.

(10) Patent No.: US 10,761,477 B2
(45) Date of Patent: Sep. 1, 2020

(54) IMAGE FORMING APPARATUS

(71) Applicants: Yoshihide Ohta, Tokyo (JP); Makoto Kikura, Kanagawa (JP); Shoji Asanuma, Kanagawa (JP); Akimitsu Obana, Kanagawa (JP); Tomoya Tanaka, Kanagawa (JP); Taiga Shoen, Kanagawa (JP)

(72) Inventors: Yoshihide Ohta, Tokyo (JP); Makoto Kikura, Kanagawa (JP); Shoji Asanuma, Kanagawa (JP); Akimitsu Obana, Kanagawa (JP); Tomoya Tanaka, Kanagawa (JP); Taiga Shoen, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/580,285

(22) Filed: Sep. 24, 2019

(65) Prior Publication Data

US 2020/0133195 A1 Apr. 30, 2020

(30) Foreign Application Priority Data

Oct. 31, 2018 (JP) ..... 2018-205915

(51) Int. Cl.

| | |
|---|---|
| ***G03G 15/00*** | (2006.01) |
| ***G03G 21/16*** | (2006.01) |
| ***G03G 15/20*** | (2006.01) |

(52) U.S. Cl.

CPC ..... *G03G 21/1685* (2013.01); *G03G 15/2053* (2013.01); *G03G 21/1619* (2013.01); *G03G 2215/00037* (2013.01)

(58) Field of Classification Search

CPC ..... G03G 21/1685; G03G 21/1619; G03G 15/2053; G03G 2215/00037

See application file for complete search history.

(56) References Cited

U.S. PATENT DOCUMENTS

2002/0018666 A1* 2/2002 Noda ..... F16D 1/101 399/90
2009/0010680 A1* 1/2009 Nanno ..... G03G 15/20 399/122

(Continued)

FOREIGN PATENT DOCUMENTS

JP 2010-078721 4/2010
JP 2010-080110 4/2010

(Continued)

*Primary Examiner* — Clayton E. LaBalle
*Assistant Examiner* — Michael A Harrison
(74) *Attorney, Agent, or Firm* — Harness, Dickey & Pierce, P.L.C.

(57) ABSTRACT

An image forming apparatus includes an apparatus body including a body side connector and a removable unit removably inserted in the apparatus body. The removable unit includes a unit side connector configured to engage with the body side connector in conjunction with insertion of the removable unit into and from the apparatus body in an insertion direction and disengage from the body side connector in conjunction with removal of the removable unit from the apparatus body in a removal direction. The apparatus further includes a first holder and a second holder. The first holder holds the body side connector and restrict the body side connector from moving in the insertion direction and the removal direction relative to the first holder. The second holder holds the first holder and restrict the first holder from moving in a direction different from the insertion direction and the removal direction.

11 Claims, 8 Drawing Sheets

(56) References Cited

U.S. PATENT DOCUMENTS

| | | | |
|---|---|---|---|
| 2014/0169828 | A1 | 6/2014 | Ohta et al. |
| 2016/0161904 | A1 | 6/2016 | Matsuda et al. |
| 2017/0060075 | A1 | 3/2017 | Shimizu et al. |
| 2017/0064109 | A1 | 3/2017 | Ishimitsu et al. |
| 2018/0067431 | A1 | 3/2018 | Nanno et al. |
| 2018/0150017 | A1 | 5/2018 | Matsuda et al. |
| 2019/0227478 | A1 | 7/2019 | Kikura et al. |

FOREIGN PATENT DOCUMENTS

| | | |
|---|---|---|
| JP | 2012-118178 | 6/2012 |
| JP | 2014-052456 | 3/2014 |
| JP | 2014-172703 | 9/2014 |
| JP | 2016-212161 | 12/2016 |
| JP | 2018-040987 | 3/2018 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-205915, filed on Oct. 31, 2018, in the Japan Patent Office, the entire disclosure of which is incorporated by reference herein.

BACKGROUND

Technical Field

Embodiments of the present disclosure relate to an image forming apparatus.

Discussion of the Background Art

An image forming apparatus is known in which a fixing unit is attachable to and detachable from an apparatus body of the image forming apparatus. Such a configuration can simplify removal of a jam sheet and facilitate maintenance, inspection, and replacement of parts by improving attaching and detaching workability.

SUMMARY

According to an embodiment of this disclosure, an image forming apparatus includes an apparatus body including a body side connector and a removable unit to be removably inserted in the apparatus body in an insertion direction. The removable unit includes a unit side connector configured to engage with the body side connector in conjunction with insertion of the removable unit into and from the apparatus body in the insertion direction and disengage from the body side connector in conjunction with removal of the removable unit from the apparatus body in a removal direction. The apparatus further includes a first holder and a second holder. The first holder is configured to hold the body side connector and restrict the body side connector from moving in the insertion direction and the removal direction relative to the first holder. The second holder is configured to hold the first holder and restrict the first holder from moving in a direction different from the insertion direction and the removal direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
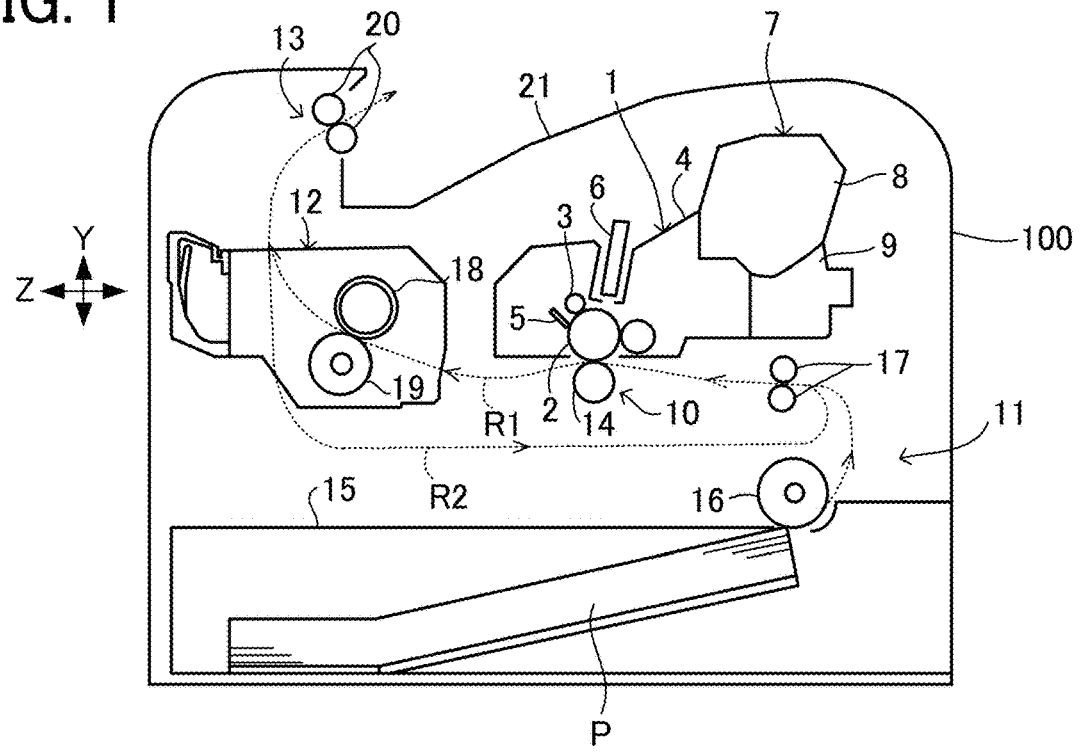
FIG. 1 is a diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic view of an image forming apparatus according to an embodiment of the present disclosure. Referring to FIG. 1, a configuration and operation of the image forming apparatus according to the present embodiment are described below.

An image forming apparatus illustrated in FIG. 1 is a monochrome image forming apparatus. A process unit 1 serving as an image forming unit is removably installed in an apparatus body 100. The process unit 1 includes a photoconductor 2 serving as an image bearer to bear images, a charging roller 3 serving as a charger to charge the surface of the photoconductor 2, a developing device 4 to develop a latent image on the photoconductor 2 into a visible image, and a cleaning device including a cleaning blade 5 to clean the surface of the photoconductor 2. The process unit 1 further includes a light-emitting diode (LED) head array 6 disposed opposite the photoconductor 2. The LED head array 6 serves as an exposure device that exposes the outer surface of the photoconductor 2.

The process unit 1 includes a toner cartridge 7 that is removably mounted in the apparatus body 100. The toner cartridge 7 serves as a powder container that contains powder toner for forming an image. The toner cartridge 7 includes an unused toner container 8 and a waste toner container 9. The unused toner container 8 contains unused toner. The waste toner container 9 contains used toner as waste toner.

The image forming apparatus further includes a transfer device 10, a sheet feeder 11, a fixing device 12, a sheet ejection device 13, and a registration roller pair 17. The transfer device 10 transfers an image onto a sheet P as a recording medium. The sheet feeder 11 feeds or supplies the sheet P. The fixing device 12 fixes the image transferred onto the sheet P by the transfer device 10. The sheet ejection device 13 ejects the sheet P outside the apparatus. The registration roller pair 17 is a timing roller pair.

The fixing device 12 is an example of a removable unit that can be attached to (or inserted into) and removed from the image forming apparatus.

The transfer device 10 includes a transfer roller 14 serving as a transfer member. The transfer roller 14 is disposed so as to contact the photoconductor 2 in a state where the process unit 1 is installed inside the image forming apparatus. Additionally, the transfer roller 14 is electrically connected to a power source and receives a predetermined amount of voltage that is either direct-current (DC) voltage, alternating current (AC) voltage, or including both.

The sheet feeder 11 includes a sheet feeding tray 15 to contain sheets P and a sheet feeding roller 16 to transport the sheets P. The sheets P may be plain paper, thick paper, thin paper, postcards, envelopes, coated paper, art paper, tracing paper, or the like. In the present embodiment, the sheets P are described as recording media. Alternatively, the recording media may be overhead projector (OHP) transparency (e.g., sheets or films), or the like.

The fixing device 12 includes a pair of rotators, that is, a fixing roller 18 (a fixing rotator) to fix an image on the sheet and a pressure roller 19 (an opposing rotator) disposed opposite the fixing roller 18. The fixing device 12 further includes a heater to heat the fixing roller 18. The pressure roller 19 is pressed against the fixing roller 18 to form a fixing nip N between the fixing roller 18 and the pressure roller 19 contacting the fixing roller 18.

The sheet ejection device 13 includes a sheet ejection roller pair 20 that ejects the sheets P outside the apparatus. Specifically, the sheet ejection roller pair 20 ejects the sheets P one at a time onto an output tray 21 disposed atop the apparatus body. Thus, the plurality of sheets P lies stacked on the output tray 21.

A conveyance passage R1 is defined by some internal components of the image forming apparatus. Specifically, the sheet P is conveyed along the conveyance passage R1 from the sheet feeding tray 15 to the sheet ejection roller pair 20 via the registration roller pair 17, the transfer nip formed between the transfer roller 14 and the photoconductor 2, and the fixing device 12. A duplex conveyance passage R2 is also defined by some internal components of the image forming apparatus. For duplex printing, the sheet past the fixing device 12 is conveyed along the duplex conveyance passage R2 again to the transfer nip.

A description is now given of the image forming operation of the image forming apparatus the present embodiment, with continued reference to FIG. 1.

When image formation is started, the photoconductor 2 is rotated, and the charging roller 3 uniformly charges the surface of the photoconductor 2 in a predetermined polarity. The LED head array 6 exposes the outer circumferential surface of the photoconductor 2 thus charged, according to image data sent from a scanner or an external device such as a computer, thereby forming an electrostatic latent image on the outer circumferential surface of the photoconductor 2. The developing device 4 supplies toner to the electrostatic latent image thus formed on the photoconductors 2, rendering the electrostatic latent image visible as a toner image.

As the image forming operation starts, the sheet feeding roller 16 starts rotating to feed a sheet P from the sheet feeding tray 15 toward the registration roller pair 17. Then, the registration roller pair 17 stops the sheet P temporarily. Thereafter, activation of the registration roller pair 17 is timed to convey the sheet P to the transfer nip such that the toner image formed on the outer circumferential surface of the photoconductor 2 meets the sheet P at the transfer nip.

When the sheet P reaches the transfer nip, a predetermined transfer voltage is applied to the transfer roller 14, thereby generating a transfer electric field to transfer the toner image from the outer circumferential surface of the photoconductor 2 onto the sheet P. The cleaning blade 5 removes residual toner from the outer circumferential surface of the photoconductor 2. The residual toner is toner that has failed to be transferred onto the sheet P and therefore remains on the outer circumferential surface of the photoconductor 2. The waste toner container 9 of the toner cartridge 7 collects the residual toner.

After the toner image is transferred onto the sheet P, the sheet P bearing the toner image is conveyed to the fixing device 12. The fixing device 12 fixes the toner image onto the sheet P under heat and pressure while the sheet P is conveyed through the fixing nip between the fixing roller 18 and the pressure roller 19. The sheet ejection roller pair 20 ejects the sheet P from the apparatus onto the output tray 21.

In duplex printing, the sheet P bearing the toner image fixed onto a front side thereof in the fixing device 12 is directed to the duplex conveyance passage R2, instead of being ejected from the apparatus. The duplex conveyance passage R2 joins the conveyance passage R1 upstream from the registration roller pair 17. The sheet P is conveyed along the duplex conveyance passage R2 and the conveyance passage R1 in this order, and the registration roller pair 17 sends out the sheet P to the transfer nip again. At the transfer nip, another toner image is transferred onto a back side of the sheet P and fixed by the fixing device 12. Thereafter, the sheet P is ejected from the apparatus.

Figure 2:
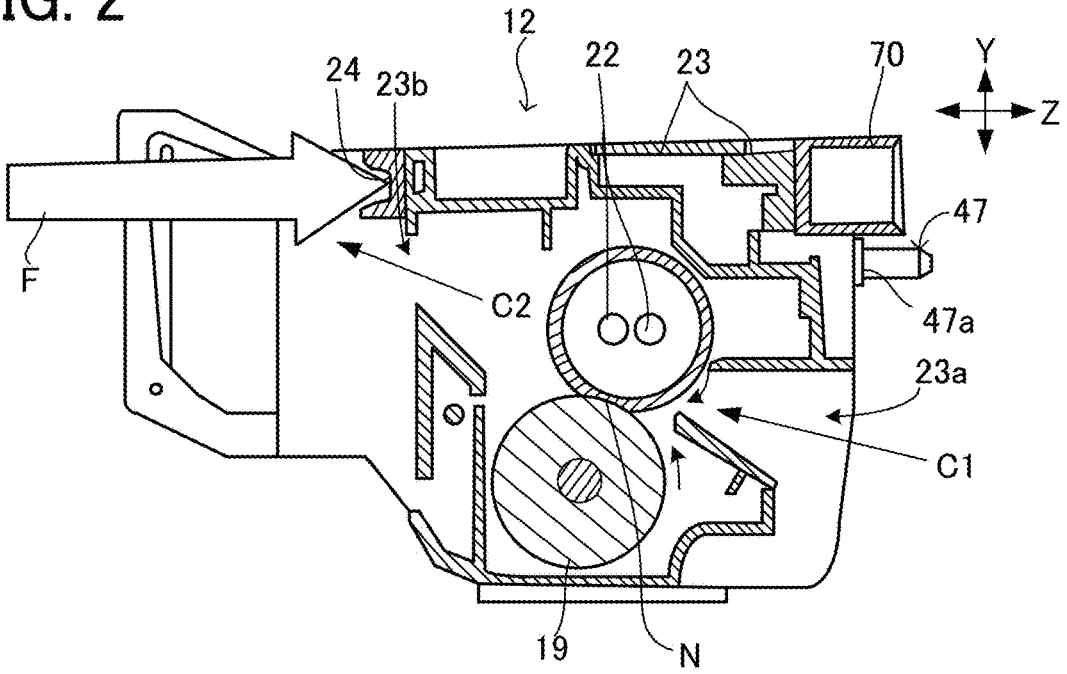
FIG. 2 is a schematic cross-sectional view of a fixing unit provided so as to be insertable into and removable from the image forming apparatus of FIG. 1.

FIG. 2 is a schematic cross-sectional view of the fixing device 12.

As illustrated in FIG. 2, the fixing device 12 includes a frame member 23 made of resin forming an exterior in which the fixing roller 18 and the pressure roller 19 are accommodated. On a front surface of the frame member 23, an inlet 23*a* for allowing the paper to enter the fixing device 12 is formed, and on a back surface of the frame member 23, an outlet 23*b* for ejecting the paper from the fixing device 12 is formed. The "front surface" of the fixing device 12 herein means a front surface of the image forming apparatus in a state in which the fixing device 12 is attached to the image forming apparatus, that is, a surface on a side on which an operator stands when issuing a print instruction by an operating unit (operation panel and the like) provided on the image forming apparatus. In the fixing roller 18, a halogen heater 22 as a heating element is provided. The pressure roller 19 is pressurized against the fixing roller 18 by a pressurizing member to be described later. The pressure roller 19 and the fixing roller 18 press against each other, and the contact portion therebetween is the fixing nip N.

In FIG. 2, a unit side drawer connector 70 as a unit side connector is provided in the fixing device 12. The unit side drawer connector 70 stores a terminal coupled to a feeder 61 or the like illustrated in FIG. 3 to be described later. A pressed recess 24 receives a pressing force F exerted by a boss on a cover 101 (illustrated in FIG. 6) that opens and is closed relative to the apparatus body 100. Specifically, the pressed recess 24 receives the pressing force F when the cover 101 is closed such that a fixing gear 18G (illustrated in FIG. 3) of the fixing device 12 inserted in the apparatus body 100 meshes with a driving gear of the apparatus body 100.

Figure 3:
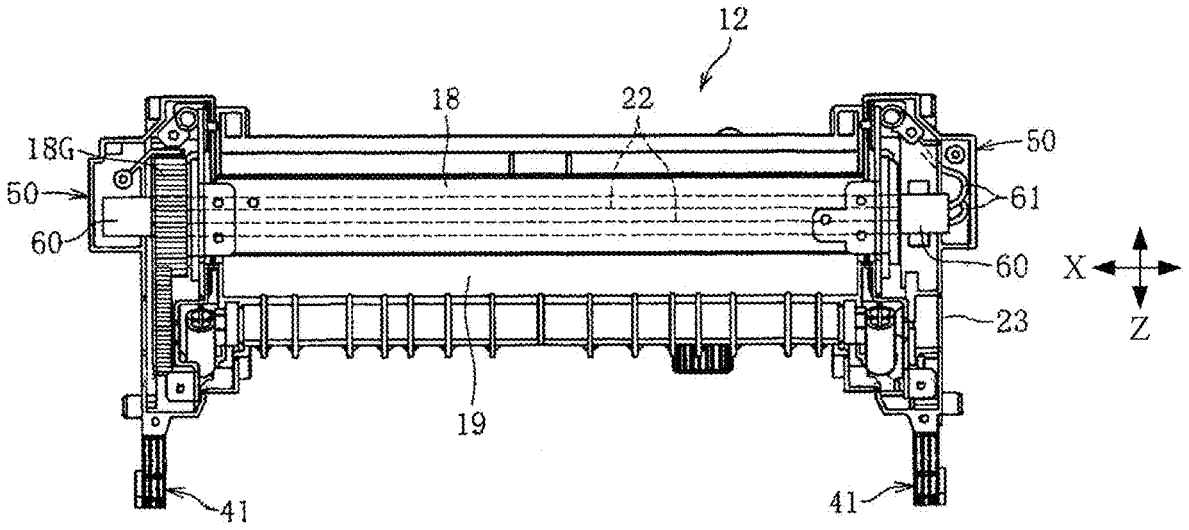
FIG. 3 is a plan view of the fixing unit of FIG. 1 with an upper part of an exterior removed.

FIG. 3 is a plan view of the fixing device 12 with an upper part of the exterior thereof removed.

As illustrated in FIG. 3, on one end of the fixing roller 18, the fixing gear 18G for connecting to the driving gear provided on the apparatus body 100 is provided. Therefore, in a state in which the fixing device 12 is attached to the apparatus body 100 and the fixing gear 18G is coupled to the driving gear, when a driving force is transmitted from a driving source on the apparatus body 100 side to the fixing roller 18, the fixing roller 18 rotary drives clockwise as indicated by an arrow in FIG. 2. The pressure roller 19 is configured to be driven to rotate counterclockwise as indicated by an arrow in FIG. 2 with respect to the fixing roller 18 which rotary drives. Thus, as the fixing roller 18 rotates driving the pressure roller 19, the sheet is conveyed while being nipped between the rollers 18 and 19. Contrary to this embodiment, the pressure roller 19 may be the driving roller, and the fixing roller 18 may be the driven roller.

In FIG. 3, an insulating base member 60 made of ceramics or the like is attached to an end of each halogen heater 22 described above, and the feeder 61 is coupled to the end of each halogen heater 22 for supplying power from a power source on the apparatus body 100 side to each halogen heater 22.

Operation of the fixing device 12 is briefly described with reference to FIG. 2.

In a state in which the fixing roller 18 is heated to predetermined temperature by radiant heat emitted from the halogen heater 22 and the fixing roller 18 and the pressure roller 19 rotate, when the paper enters the fixing nip N in a direction indicated by an arrow C1 in FIG. 2, the paper is conveyed while being nipped between the fixing roller 18 and the pressure roller 19. At that time, an unfixed image on the paper is heated by the heat of the fixing roller 18 and pressurized by the fixing roller 18 and the pressure roller 19, so that the image is fixed on the paper. The paper on which the image is fixed is ejected from the fixing nip N in a direction of an arrow C2 in FIG. 2.

A detailed configuration of the fixing device 12 is hereinafter described.

Figure 4:
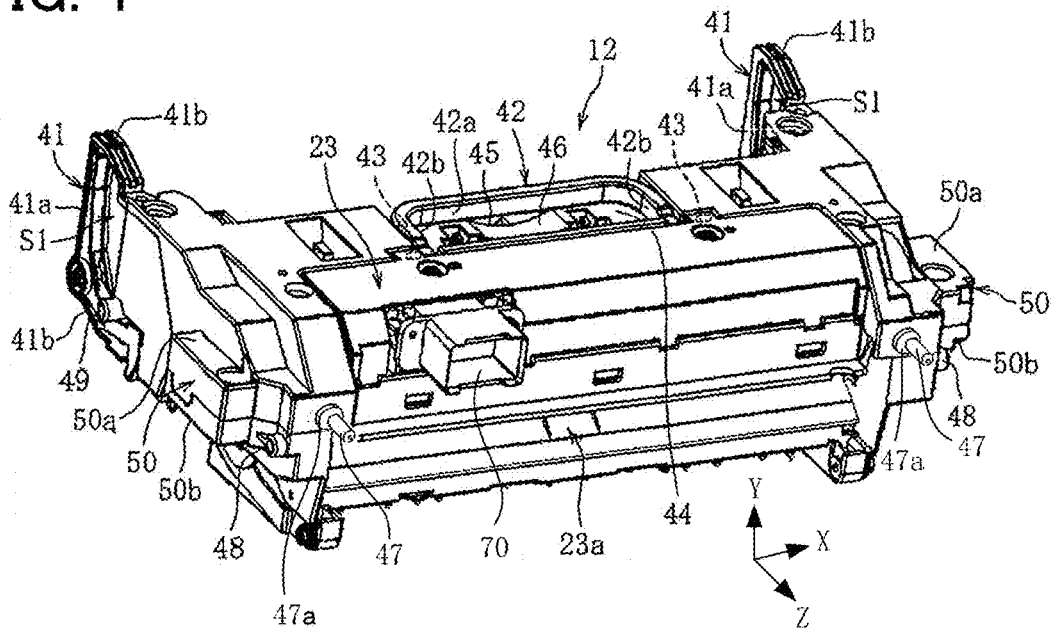
FIG. 4 is a perspective view of a front surface side of the fixing unit of FIG. 1 as seen obliquely from above.

FIG. 4 is a perspective view of a front surface side of the fixing device 12 as seen obliquely from above.

As illustrated in FIG. 4, the frame member 23 is provided with a first handle 41 and a second handle 42 gripped by the operator when the fixing device 12 is attached to and detached from the apparatus body 100. The first handle 41 is provided on each of right and left ends of the back surface of the frame member 23, and the second handle 42 is provided at the center in a horizontal direction of an upper surface of the frame member 23.

A pair of first handles 41 is formed to be symmetrical to each other. Specifically, each first handle 41 includes a grip 41*a* extending in a vertical direction and a pair of arms 41*b* extending forward (toward the front surface) from upper and lower ends of the grip 41*a*, and the grip 41*a* is secured to the back surface of the frame member 23 via the pair of arms 41*b*. Between each grip 41*a* and the back surface of the frame member 23, a space S1 in which the operator may insert his/her hand or finger is formed.

The second handle 42 is provided so as to be rotatable (that is, pivotable) within a range of a predetermined angle with respect to the frame member 23. Specifically, the second handle 42 has a grip 42*a* extending horizontally and a pair of arms 42*b* extending in a direction orthogonal to or intersecting with the grip 42*a*, and a tip end of each arm 42*b* is pivotably attached to the frame member 23 via a support shaft 43. Since the second handle 42 pivots about the support shaft 43, the second handle 42 is switched between a fallen state illustrated in FIG. 4 and an upright state. In the state illustrated in FIG. 4, the second handle 42 is accommodated in a concave accommodating portion provided on an upper portion of the frame member 23. In contrast, in the upright state of the second handle 42, the second handle 42 projects outward (upward) from an accommodated state illustrated in FIG. 4 and is brought into a usage state in which this is usable as the handle. That is, in the usage state, a space in which the operator may insert his/her hand or finger to grip the grip 42*a* is formed between the grip 42*a* of the second handle 42 and the upper surface of the frame member 23 is formed.

In the accommodating portion, two concave portions 45 and 46 are provided to make it easy to hook the finger on the second handle 42 when the second handle 42 is switched from the accommodated state to the usage state. One is a first concave portion 45 formed by recessing the center of a rear end edge of the accommodating portion 44 forward, and the other is a second concave portion 46 formed by recessing the center of an upper surface of the accommodating portion 44 downward.

As illustrated in FIG. 4, the frame member 23 is further provided with a plurality of positioning portions for positioning the fixing device 12 with respect to the apparatus body 100. The plurality of positioning portions includes first positioning projections 47 provided on right and left ends on the front surface of the frame member 23, a pair of second positioning projections 48 provided on a front surface side of a left side surface and a right side surface of the frame member 23, and a pair of third positioning projections 49 provided on a back surface side of the left side surface and the right side surface of the frame member 23.

When the fixing device 12 is attached to the apparatus body 100 to occupy an attachment position, a positioning abutment surface 47*a* (refer to FIG. 2 and the like) on a base of the first positioning projection 47 abuts a positioning abutment surface 105*a* (refer to FIG. 6) as an apparatus body side positioning portion of an apparatus body frame member 105 adhered to the apparatus body 100 side, so that the fixing device 12 is positioned in an insertion and removal direction (hereinafter, also simply "insertion direction" or "Z direction").

On each of the left side surface and the right side surface of the frame member 23, a guide projection 50 as a convex guide guided along an apparatus body side guide to be described later when the fixing device 12 is attached to or detached from (inserted into/removed from) the apparatus body 100 is provided. Each guide projection 50 is formed into a rectangular shape (substantially rectangular or substantially square) and upper and lower flat surfaces of which serve as an upper sliding surface 50*a* and a lower sliding surface 50*b* which slide on the apparatus body side guide. In this embodiment, when the fixing device 12 is attached/detached (inserted/removed), portions other than the guide projection 50 in the fixing device 12 are prevented from sliding with respect to the apparatus body 100 (exhibiting a guide function), so that a sliding resistance is reduced and operability is improved.

Figure 5:
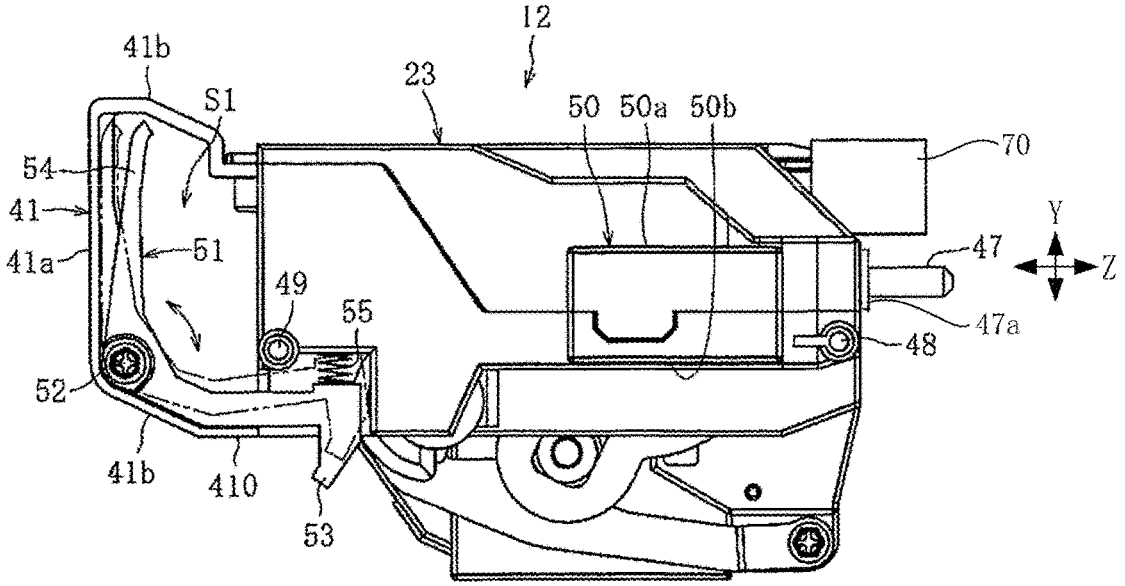
FIG. 5 is a side view of the fixing unit of FIG. 1 as seen from the left.

FIG. 5 is a side view of the fixing device 12 as seen from the left.

As illustrated in FIG. 5, the fixing device 12 is provided with a lock 53 which secures the fixing device 12 so as not to be detached in a state of being attached to the apparatus body 100. The lock 53 is provided on a part of the rotary member 51 rotatably (pivotably) provided on the first handle 41. The rotary member 51 is formed into a substantially shape, and the lock 53 is provided on a tip end of a portion extending forward (toward the front surface) from a pivoting center (fulcrum 52) thereof. A portion extending upward from the pivoting center (fulcrum 52) of the rotary member 51 is an operating unit 54 for allowing the operator to perform rotating operation on the rotary member 51.

The lock 53 is always biased downward by a compression coil spring 55 as a biasing member arranged between an upper surface thereof and a lower surface of the frame member 23. Therefore, in a state in which the operator does not perform the rotating operation on the rotary member 51, a lower portion of the rotary member 51 abuts a bottom 410 of the lower arm 41*b*, and a tip end (lower end) of the lock 53 is held in a state significantly projecting downward from the bottom 410 of the lower arm 41*b* (state indicated by solid line in FIG. 5). In this state, the lock 53 is put into a lockable state engageable with an engaging portion to be described later provided on the apparatus body 100 side.

In contrast, in a case where the operator rotates the rotary member 51 counterclockwise in FIG. 5 against a biasing force of the compression coil spring 55, the tip end of the lock 53 retracts upward to put into an unlockable state (state indicated by dashed-two dotted line in FIG. 5) in which this does not engage with the engaging portion on the apparatus body 100 side. In this manner, when the operator operates the operating unit 54 to rotate the rotary member 51, it is possible to switch the lock 53 between the lockable state and the unlockable state. The rotary member 51 is similarly provided on the first handle 41 on the right side.

Figure 6:
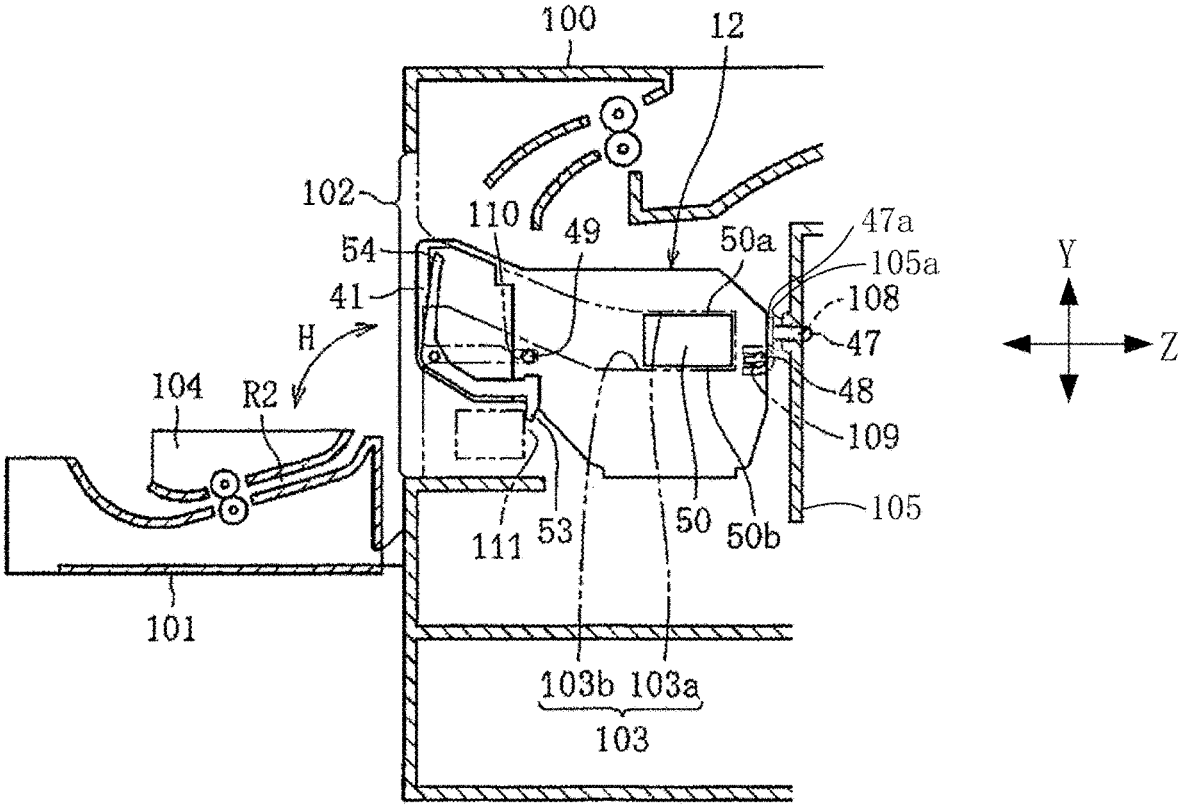
FIG. 6 is a schematic cross-sectional view of an apparatus body in a state in which the fixing unit of FIG. 1 is attached to the apparatus body.

FIG. 6 is a schematic cross-sectional view of the apparatus body in a state in which the fixing unit is attached to the apparatus body.

As illustrated in FIG. 6, the cover 101 is disposed on a back side (the face on the left side in the drawing) of the apparatus body 100. The cover 101 rotates (pivots) in the direction indicated by arrow H in FIG. 6 to be opened and closed. The state illustrated in FIG. 6 is a state in which the cover 101 is opened and an opening 102 is formed on the back surface of the apparatus body 100. In this state, the fixing device 12 may be detached backward from the opening 102. A method of attaching and detaching the fixing device 12 is described later in detail.

The cover 101 is integral with a sheet reversal unit 104 which forms a part of the sheet reversal passage R2. Therefore, as illustrated in FIG. 6, when the cover 101 is opened, the sheet reversal unit 104 rotates (pivots) together with the cover 101 and retracts from the vicinity of the back surface of the fixing device 12.

On inner surfaces of a left side wall and a right side wall of the apparatus body 100, a pair of guide rails 103 is provided. The guide rails 103 serve as the apparatus body side guides and guide attaching and detaching of the fixing device 12 to and from the apparatus body 100. Each guide rail 103 includes an upper guide surface 103*a* and a lower guide surface 103*b*. When the fixing device 12 is attached or detached, the upper sliding surface 50*a* and the lower sliding surface 50*b* of the guide projection 50 slide on the upper guide surface 103*a* and the lower guide surface 103*b*, so that the fixing device 12 is guided.

As illustrated in FIG. 6, the apparatus body 100 is provided with a plurality of apparatus body side positioning portions for positioning the fixing device 12 with respect to the apparatus body 100. The plurality of apparatus body side positioning portions includes a first apparatus body side positioning portion 108 which engages with the first positioning projection 47 provided on the fixing device 12 to mainly position the fixing device 12 in a horizontal direction (hereinafter, also referred to as an "X direction"), a front-back direction, or the insertion and removal direction (the above-described Z direction) in FIG. 4, a second apparatus body side positioning portion 109 which engages with the second positioning projection 48 provided on the fixing device 12 to mainly position the fixing device 12 in an anterior direction and a vertical direction (hereinafter also referred to as a "Y direction"), and a third apparatus body side positioning portion 110 which engages with the third positioning projection 49 provided on the fixing device 12 to mainly position the fixing device 12 in a rotational direction around the second positioning projection 48.

The apparatus body 100 is also provided with an engaging portion 111 with which the lock 53 of the fixing device 12 engages. The state illustrated in FIG. 6 is a state in which the lock 53 engages with the engaging portion 111, and in this state, the fixing device 12 is positioned in a posterior direction, and movement in a detaching direction is restricted. An attaching/detaching, method of the fixing device 12 and an advantage thereof are substantially similar to those disclosed in paragraphs 0079 to 0093 of US-20180067431-A1 (U.S. Pat. No. 10,036,987-B2) by the present applicant.

As described above, in this embodiment, the fixing device 12 is configured to be insertable into/removable from the apparatus body 100, thereby improving fixing device 12 attachability to/detachability from the apparatus body 100. In this manner, operability of the fixing device 12 at the time of maintenance and inspection is improved.

The fixing device 12 is configured to be attached to the apparatus body 100 with a certain amount of play by a lever member, various positioning members, and the like. The insertion and removal direction of the fixing device 12 (Z direction), an engagement direction to an apparatus body side drawer connector (to be described later with reference to FIGS. 7A and 7B) provided on the apparatus body 100 side which fits to the unit side drawer connector 70 illustrated in FIGS. 2, 5 and the like (insertion and removal direction and Z direction, too), and a direction in which the fixing device 12 is pressed (insertion and removal direction and Z direction, too) coincide with one another. As an abutment position of the fixing device 12 is determined on an abutment surface of the first apparatus body side positioning portion 108 on the apparatus body 100 side illustrated in FIG. 6, a position between the driving gear on the apparatus body 100 side and the fixing gear 18G on the fixing device 12 side is determined, so that driving can be transmitted as illustrated in FIG. 3.

Figure 7B:
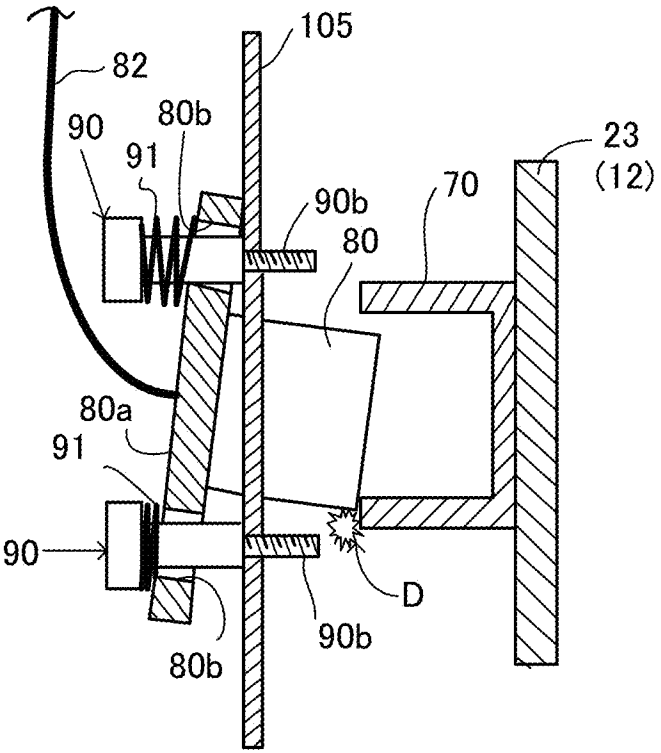
FIGS. 7A and 7B are views for explaining a fitting configuration of drawer connectors according to a comparative example.
Figure 7A:
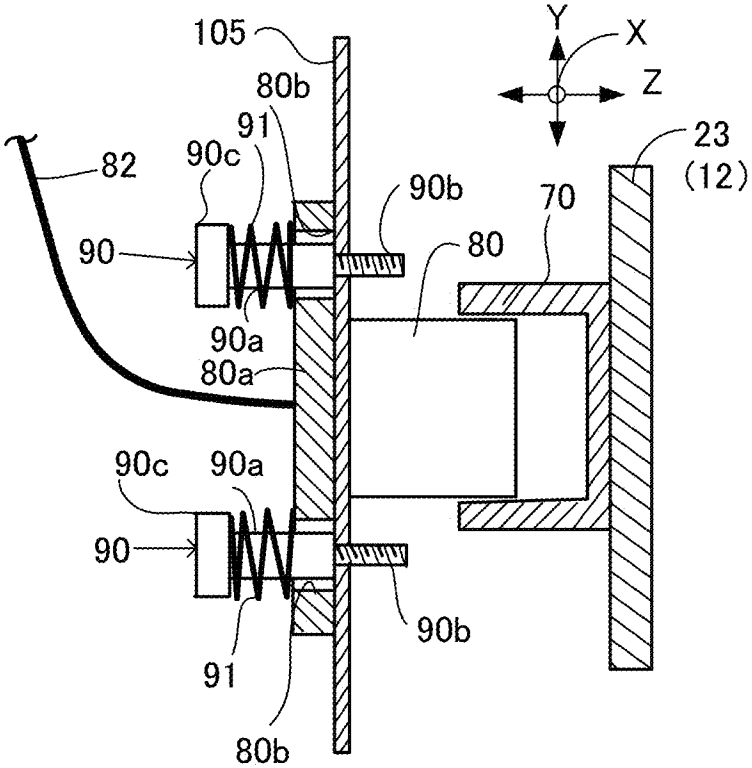

Referring to FIGS. 7A and 7B, a comparative example regarding a fitting configuration of drawer connectors is described. FIG. 7A illustrates a configuration and operation when the drawer connectors are fitted without disadvantage in the comparative example, and FIG. 7B illustrates a configuration and operation when the drawer connectors cause a disadvantage such as breakage in the comparative example.

FIGS. 7A and 7B schematically illustrates, as an end view, a cross-section of the unit side drawer connector 70 secured to a frame member 23 on the fixing device 12 side (indicated with parentheses in FIGS. 7A and 7B). In FIGS. 7A and 7B, an apparatus body frame member 105 and the like fixed to the apparatus body 100 are simplified or schematically illustrated. In the comparative example, an apparatus body side drawer connector 80 is attached to the apparatus body frame member 105. In FIG. 6 described above, the unit side drawer connector 70 and the apparatus body side drawer connector 80 attached to the apparatus body frame of the embodiment are not illustrated for simplifying the illustration. From the same point of view the illustration of a terminal shape with which the unit side drawer connector 70 and the apparatus body side drawer connector 80 fit is entirely omitted in an embodiment including an example to be described later.

As illustrated in FIG. 7A, the mechanism for engagement (inserting/removing and fitting) of the apparatus body side drawer connector 80 with the unit side drawer connector 70 includes the apparatus body side drawer connector 80, a stepped screw 90, and a compression coil spring 91. The unit side drawer connector 70 and the apparatus body side drawer connector 80 are ready-made drawer connectors. The unit side drawer connector 70 is a female type (receptacle) having a concave shape, and the apparatus body side drawer connector 80 is a male type (plug) having a convex shape.

The unit side drawer connector 70 is positioned in three-dimensional directions of an X direction, a Y direction, and a Z direction on the frame member 23 on the fixing device 12 side, and is secured by a fastening member such as a screw. The same applies to the structure according to the embodiment described later.

The apparatus body side drawer connector 80 includes an attachment seat 80*a* integral therewith. A plurality of (two in FIGS. 7A and 7B) attaching holes 80*b* for attaching the apparatus body side drawer connector 80 is formed on the attachment seat 80*a*. The stepped screw 90 includes an outer diameter portion 90*a* having a predetermined clearance with respect to an inner diameter of the attaching hole 80*b*, a screw portion 90*b* in which a male screw to be fastened to a female screw on the apparatus body frame member 105 is formed, and a flange 90*c* on which a fastening shape fastened by a tool is formed having an outer diameter larger than the inner diameter of the attaching hole 80*b* of the apparatus body side drawer connector 80 integrally formed.

As illustrated in FIG. 7A, the apparatus body side drawer connector 80 is configured to nip the compression coil spring 91 between the flange 90*c* of the stepped screw 90 and the attachment seat 80*a* of the apparatus body side drawer connector 80, thereby pressing to hold the apparatus body side drawer connector 80 to make the apparatus body side drawer connector 80 freely movable in the X direction, the Y direction, and the Z direction (three-dimensional directions). In other words, the comparative holding structure of the apparatus body side drawer connector 80 is configured to cause over stroke, in particular, in the Z direction which is the insertion and removal direction.

Therefore, posture deviation of the unit side drawer connector 70 when inserting the fixing device 12 into the apparatus body is absorbed, and the connectors of the unit side drawer connector 70 and the apparatus body side drawer connector 80 can be fitted in the positioned state. As a result, it is possible to prevent contact failure due to rubbing or scraping of the connector terminals because of motion to slide also in the Z direction and a force to separate the drawer connectors applied to the unit side drawer connector 70 fitting to the apparatus body side drawer connector 80 by thermal contraction of the fixing device 12, slight vibration at the time of operation, reverse operation of a driving unit and the like. That is, electrical contact can be maintained without abrasion of the drawer connectors.

As illustrated in FIGS. 7A and 7B, a harness 82 for supplying power to the fixing device 12 is coupled to the apparatus body side drawer connector 80, but since the fixing device 12 uses a primary power source, this has a larger harness diameter and stronger stiffness as the harness 82 for power supply, so that when this is arranged in a space-saving manner, a force to fall to the apparatus body side drawer connector 80 acts by a load by bending of the harness 82.

Here, as illustrated in FIG. 7B, a holding mechanism of a conventional configuration of the apparatus body side drawer connector 80 is free about inclination in the X direction, the Y direction, and the Z direction (three dimensional directions), so that a holding posture of the apparatus body side drawer connector 80 with respect to the apparatus body frame member 105 changes depending on the stiffness of the harness 82, and the drawer connectors do not align when inserting/removing the fixing device 12 (in particular, when inserting) and there is a fear or failure that the drawer connector is damaged as denoted by a reference sign D. As illustrated in FIG. 7B, the fall of the apparatus body side drawer connector 80 remarkably occurs in particular in the Y direction which is a short direction of the drawer connector.

In order to prevent the above-described failure, a biasing force (spring force) of the compression coil spring 91 attached the apparatus body side drawer connector 80 can be strengthened, but a strong spring force is required for sufficiently correct the posture of the apparatus body side drawer connector 80 and a force to strongly push back the fixing device 12 is generated when attaching the fixing device 12, so that a distance between fixing gears 18G described with reference to FIG. 3 becomes larger and driving force transmission becomes poor.

In order to prevent the above-described failure and disadvantage, a pressing force F by the cover 101 described with reference to FIG. 2 can be increased. However, in a case where the pressing force F by the cover 101 is increased, heat of the fixing device 12 is received in a state where a large load is applied to the cover 101 arranged in the vicinity of the fixing device 12, and the cover 101 deforms due to deterioration with time and the fixing device 12 is displaced, resulting in poor driving force transmission.

Figure 8:
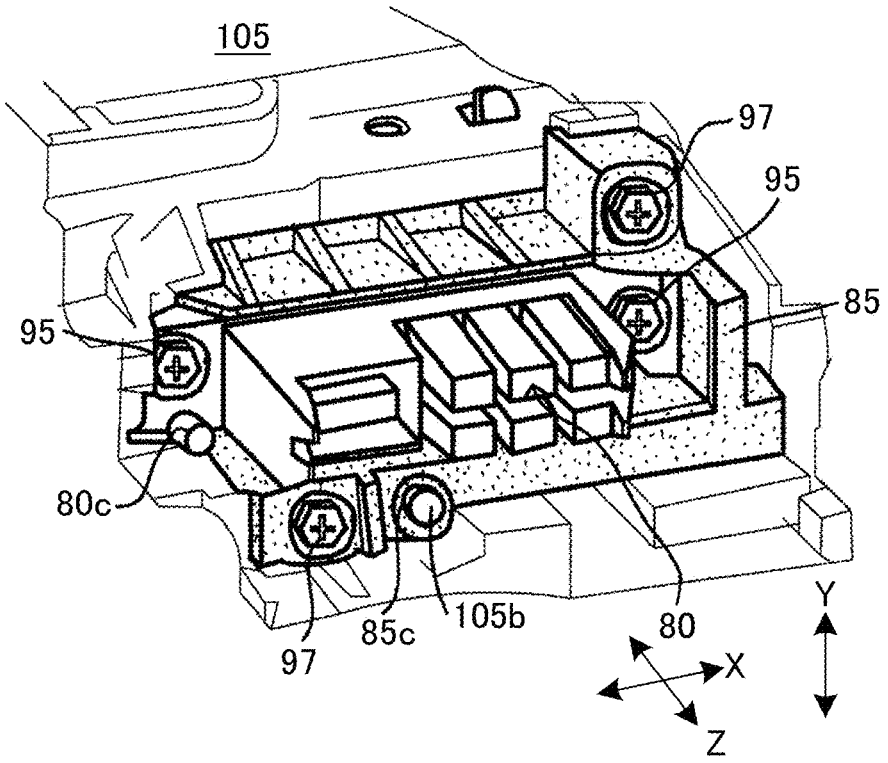
FIG. 8 is a perspective view of a main part illustrating a holding configuration of an apparatus body side drawer connector according to the example.
Figure 9B:
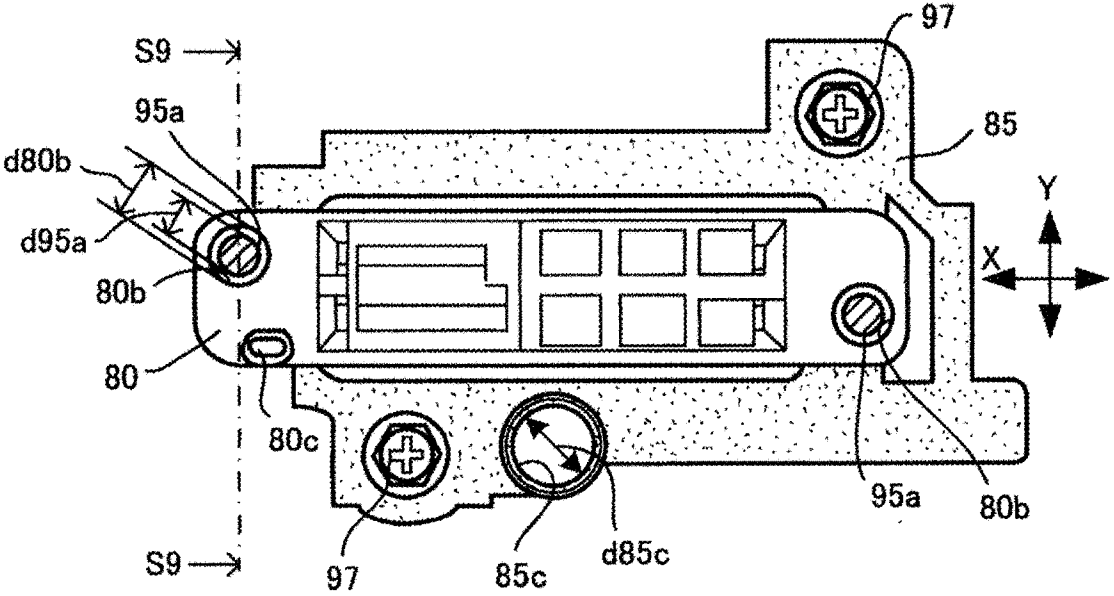
FIG. 9B is a front view of the main part illustrating an attaching and holding relationship relative to a connector holding bracket of the apparatus body side drawer connector of FIG. 8.
Figure 9A:
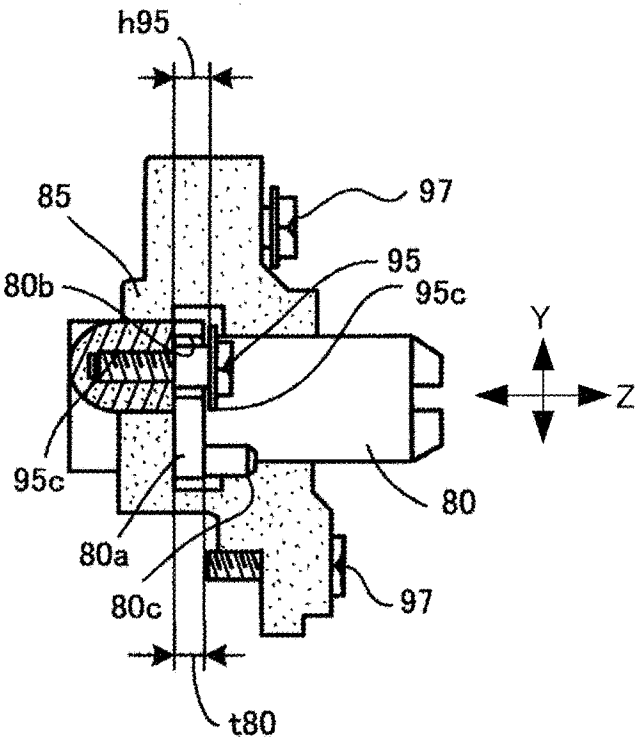
FIG. 9A is a cross-sectional view of the main part taken along line S9-S9 of FIG. 9B and illustrates the holding configuration of the apparatus body side drawer connector according to the example.
Figure 10B:
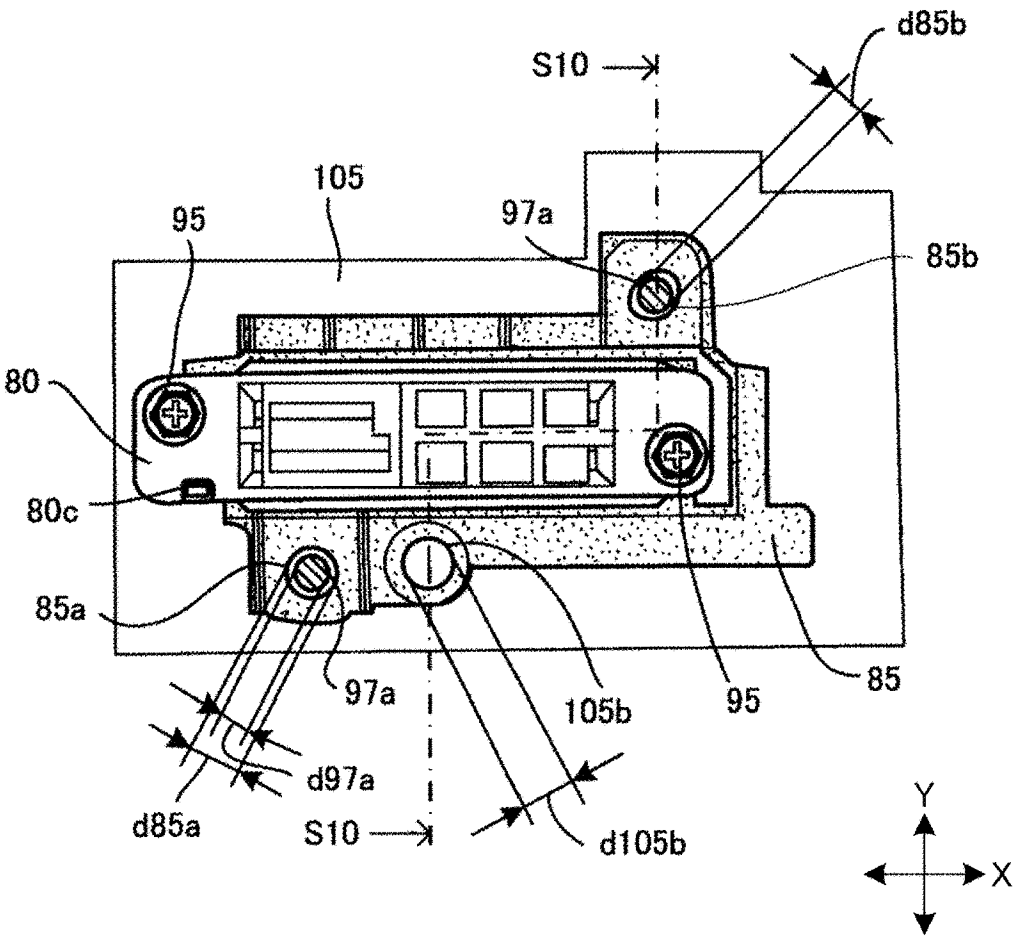
FIG. 10B is a front view of the main part illustrating an attaching and holding relationship relative to an apparatus body frame member of the apparatus body side drawer connector via the connector holding bracket of FIG. 8.

Referring to FIGS. 8 to 10B, a structure to solve the above-described disadvantage in the comparative example is described. FIG. 8 is a perspective view of a main part of a holding configuration of the apparatus body side drawer connector according to the present embodiment. FIG. 9A is a cross-sectional view taken along line S9-S9 of FIG. 9B, and FIG. 9B is a front view of a main part including a partial cross-section (stepped screw 95) illustrating an attaching/ holding relationship with respect to a connector holding bracket of the apparatus body side drawer connector of FIG. 8. FIG. 10A is a cross-sectional view taken along line S10-S10 of FIG. 10B, and FIG. 10B is a front view of the main part including a partial cross-section (stepped screw 97) illustrating an attaching/holding relationship with respect to the apparatus body frame member of the apparatus body side drawer connector via the connector holding bracket of FIG. 8.

As illustrated in FIG. 8, the apparatus body side drawer connector 80 which can be inserted into and removed from the unit side drawer connector 70 illustrated in FIGS. 7A and 7B in the Z direction is attached to a connector holding bracket 85 by the two stepped screws 95. The connector holding bracket 85 is attached to the apparatus body frame member 105 by two stepped screws 97. The connector holding bracket 85 is a novel member which is not used in the comparative example described above, and is indicated by a mat (sand) pattern including a cross-section in order to facilitate discrimination in shape from the apparatus body side drawer connector 80 and the apparatus body frame member 105. The connector holding bracket 85 is molded as a single piece with a heat-resistant resin.

FIGS. 8, 9A, and 9B illustrate a projection 80*c* that prevents erroneous assembling of front and back sides of the apparatus body side drawer connector 80.

In FIGS. 8 to 10B, the apparatus body frame member 105 includes a guide boss 105*b* (a projection), and the connector holding bracket 85 includes a guide boss hole 85*c*. As the guide boss 105*b* engages with and fits in the guide boss hole 85*c*, the connector holding bracket 85 is guided so as to move in the Z direction with respect to the apparatus body frame member 105 as described later. The apparatus body frame member 105 has a three dimensional shape including a reinforcing rib so as to serve as an attaching member. However, as compared with the connector holding bracket 85 or the apparatus body side drawer connector 80, the apparatus body frame member 105 is schematically illustrated, that is, the outline thereof is illustrated with a thinner line.

Here, the two stepped screws 95 and the connector holding bracket 85 serve as a first holder for holding the apparatus body side drawer connector 80. The two stepped screws 97 and the apparatus body frame member 105 serve as a second holder for holding the first holder.

As illustrated in FIGS. 9A and 9B, the connector holding bracket 85 is held by the two stepped screws 95. As illustrated in FIG. 9B, an outer diameter d95*a* of a shaft diameter portion 95*a* of each stepped screw 95 is φ3.5 mm, and a diameter d80*b* of the attaching hole 80*b* of the apparatus body side drawer connector 80 is φ5.0 mm; the apparatus body side drawer connector 80 can move only along the XY plane by this difference of ±0.75 mm.

A thickness t80*a* of the attachment seat 80*a* of the apparatus body side drawer connector 80 is 2.0 mm, and a height h95 from a lower surface of the flange 95*c* of the stepped screw 95 to a stepped portion of the shaft diameter portion 95*a* is 2.1 mm, so that the apparatus body side drawer connector 80 floats by a clearance of 0.1 mm, and the apparatus body side drawer connector 80 does not fall to the connector holding bracket 85.

Figure 10A:
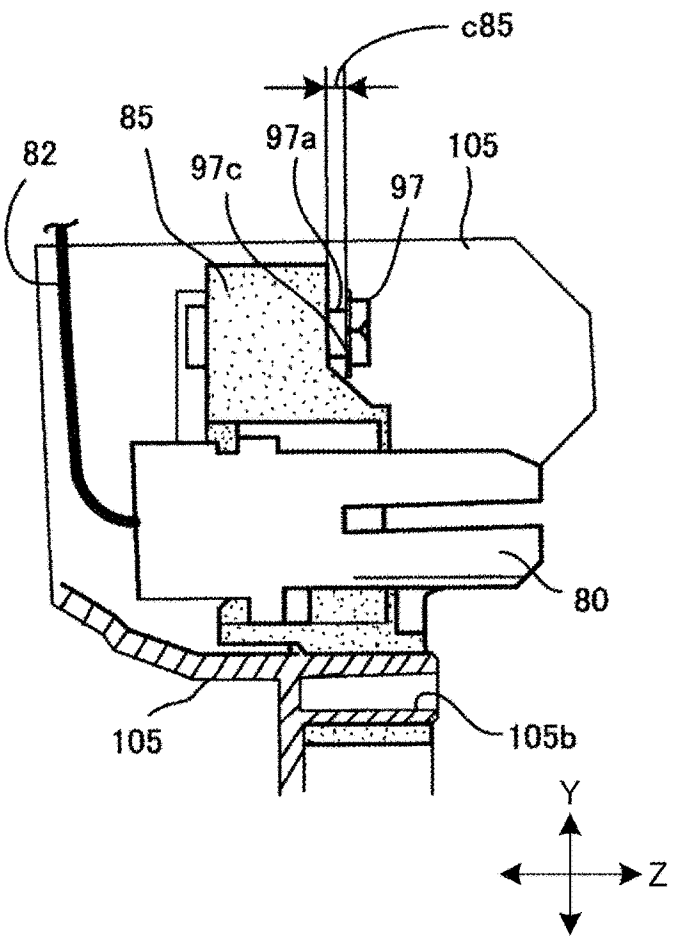
FIG. 10A is a cross-sectional view of the main part, taken along line S10-S10 of FIG. 10B, and illustrates the holding configuration of the apparatus body side drawer connector according to the example.

As illustrated in FIGS. 10A and 10B, the connector holding bracket 85 is held by the apparatus body frame member 105 with the two stepped screws 97. The connector holding bracket 85 is guided by the guide boss 105*b* on the apparatus body frame member 105 so as to be movable only in the Z direction. Attaching holes 85*a* and 85*b* which are fastened portions of the connector holding bracket 85 are held with a predetermined clearance between a shaft diameter portion 97*a* of the stepped screw 97.

As in FIG. 10B, on the connector holding bracket 85, an attaching hole 85*a* and a long hole 85*b* for attaching the stepped screw 97 are formed. An outer diameter d97*a* of the shaft diameter portion 97*a* of the stepped screw 97 is 0.5 mm, a diameter d85*a* of the attaching hole 85*a* is φ3.6 mm, and a diameter d85*b* of the long hole 85*b* is φ3.6×5.6 mm.

As specifically illustrated in FIG. 10A, the connector holding bracket 85 is configured as follows. When a screw portion of the steeped screw 97 is fully fastened to the female screw on the apparatus body frame member 105, a clearance c85 of 1.0 mm is secured with respect to a length from a flange 97*c* of the stepped screw 97 to a stepped portion of the shaft diameter portion 97*a*. By this, the connector holding bracket 85 is movable relative to the apparatus body frame member 105 in a range of 1.0 mm or smaller in the Z direction.

In FIGS. 9 and 10, a guide boss diameter d105*b* of the guide boss 105*b* of the apparatus body frame member 105 is φ6.0 mm, and a diameter d85*c* of the guide boss hole 85*c* of the connector holding bracket 85 through which the guide boss 105*b* is inserted is φ6.1 mm.

One of the attaching holes of the connector holding bracket 85 to/into which the stepped screw 97 is attached/inserted can be used as a positioning hole and the other can be used as a rotation stopper without individually providing the guide boss on the apparatus body frame member 105 side.

As described above, the two stepped screws 95 and the connector holding bracket 85 (first holder) together hold the apparatus body side drawer connector 80 and restrict the apparatus body side drawer connector 80 from moving in the Z direction which is the insertion and removal direction. Further, the two stepped screws 97 and the apparatus body frame member 105 (second holder) together hold the two stepped screws 95 and the connector holding bracket 85 (first holder) and restrict the two stepped screws 95 and the connector holding bracket 85 from moving in a direction different from the Z direction.

Furthermore, the apparatus body side drawer connector 80 is held so as to be movable in the XY plane being the plane orthogonal to the Z direction relative to the two stepped screws 95 and the connector holding bracket 85 (first holder). The two stepped screws 95 and the connector holding bracket 85 (first holder) are held so as to be movable in the Z direction relative to the two stepped screws 97 and the apparatus body frame member 105 (second holder).

According to the above-described example, a basic effect can be obtained that connector contactability relative to the movement of the fixing device 12 in the insertion and removal direction is secured by a compact and relatively inexpensive configuration. The apparatus body side drawer connector 80 and the unit side drawer connector 70 can be surely engaged with each other in conjunction with the insertion of the fixing device 12 into the apparatus body 100.

The connector holding bracket 85 is configured not to be displaced, by rotational components in the XY plane and the Z direction, from the apparatus body frame member 105. Accordingly, the connector holding bracket 85 can follow the apparatus body frame member 105 in the Z direction while preventing damage to the connectors engaged with each other by position adjustment on the XY plane. This configuration can be free of risk of connector abrasion and the like.

The apparatus body side drawer connector 80 and the unit side drawer connector 70 are ready-made drawer connectors, and the holders thereof are normally short in straight length in the fitting and insertion and removal direction. Therefore, when used as sliding holders in the fitting direction, these drawer connectors are easily inclined and galling easily occurs. Therefore, when holding the apparatus body side drawer connector 80, by restricting the movement in a direction parallel to the fitting direction and allowing the movement in the plane orthogonal to the fitting direction, inclination preventing accuracy of the apparatus body side drawer connector 80 is further improved.

Figure 11:
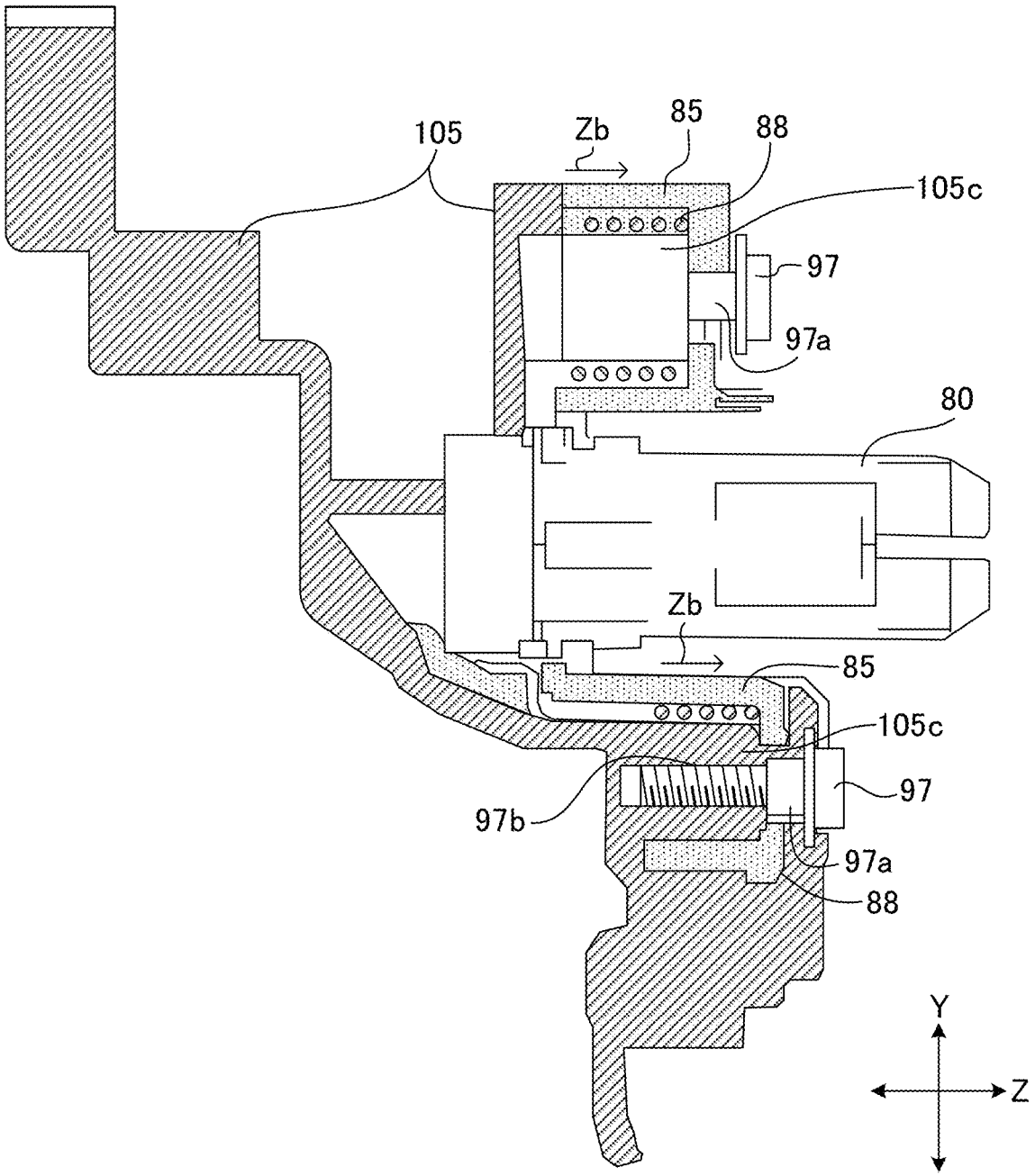
FIG. 11 is a cross-sectional view of a main part illustrating a holding configuration of an apparatus body side drawer connector according to a variation.

Referring to FIG. 11, a variation of the above-described embodiment is described. FIG. 11 is a cross-sectional view of a main part illustrating a holding configuration of an apparatus body side drawer connector according to the variation.

The variation illustrated in FIG. 11 is mainly different from the example illustrated in FIGS. 8 to 10B in adding a compression coil spring 88 as a pressing member or a biasing member between an outer peripheral surface of a pedestal 105*c* that is integral with the apparatus body frame member 105 and the connector holding bracket 85 located on an outer side thereof. Examples of the biasing member is not limited to springs, but include, for example, a sponge to exert elasticity and a solenoid to exert electromagnetic force.

The pedestal 105*c* is integral with the apparatus body frame member 105 and engaged with a screw portion 97*b* of the stepped screw 97 to be screwed. The compression coil spring 88 acts to press the connector holding bracket 85 against the fixing device 12 with a relatively small force when the fixing unit is inserted into an apparatus body as illustrated in FIG. 11. In FIG. 11, in order to illustrate a characteristic of the present disclosure, it is intentionally illustrated that a clearance c85 similar to that illustrated in FIGS. 10A and 10B occurs.

According to the variation, by adding the compression coil spring 88 as the pressing member, the apparatus body side drawer connector 80 is pressed toward the fixing unit with a small force, so that even in a case where a sliding load occurs due to a change in surface state by abrasion over time and contamination of dust, the pedestal 105*c* presses in a balanced manner to be assisted, therefore operation in a Zb direction of the apparatus body side drawer connector 80 is not slow and uncertain. Therefore, connector connection/fitting property can be reliably ensured in accordance with minute vibration of the fixing unit.

Although a preferred embodiment of the present disclosure is described above, the present disclosure is not limited to such specific embodiment and example, and can be variously modified/changed without departing from the scope of the present disclosure recited in claims unless limited in particular in the description above. For example, the technical matters described in the above embodiment, example and the like can be appropriately combined.

The "removable unit" (insertion/removal unit or attaching/detaching unit) according to the present disclosure is a general term of a unit insertable into and removable from an apparatus body having the unit side connector to be fitted with an apparatus body side connector. Therefore, the insertion/removal unit according to the present disclosure is not limited to the fixing unit described in the above embodiment, but also includes a double-sided unit, an image bearer unit and the like, and can be applied thereto.

The effects described in the embodiments of this disclosure are listed as most preferable effects derived from this disclosure, and therefore are not intended to limit to the embodiments of this disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body including a body side connector;

a removable unit to be removably inserted in the apparatus body in an insertion direction, the removable unit including a unit side connector configured to:

engage with the body side connector in conjunction with insertion of the removable unit into and from the apparatus body in the insertion direction; and disengage from the body side connector in conjunction with removal of the removable unit from the apparatus body in a removal direction;

a first holder configured to hold the body side connector and restrict the body side connector from moving in the insertion direction relative to the first holder; and a second holder configured to hold the first holder and restrict the first holder from moving in a direction different from the insertion direction and the removable direction, wherein the first holder is configured to hold the body side connector movably, in a plane perpendicular to the insertion direction and the removable direction, relative to the first holder, wherein the second holder is configured to hold the first holder movably, in the insertion direction and the removable direction, relative to the second holder, and wherein the removable unit is a fixing unit including a pair of rotators, the pair of rotators pressing against each other and forming a nip to fix a toner image on a recording medium.

2. The image forming apparatus of claim 1, wherein each of the body side connector and the unit side connector is a ready-made drawer connector.

3. The image forming apparatus of claim 2, wherein the removable unit is a fixing unit including a pair of rotators, the pair of rotators pressing against each other and forming a nip to fix a toner image on a recording medium.

4. The image forming apparatus of claim 1, further comprising a biasing member configured to press the first holder against the removable unit being in the apparatus body.

5. The image forming apparatus of claim 1, wherein each of the body side connector and the unit side connector is a ready-made drawer connector.

6. The image forming apparatus of claim 1, wherein the removable unit is a fixing unit including a pair of rotators, the pair of rotators pressing against each other and forming a nip to fix a toner image on a recording medium.

7. An image forming apparatus, comprising:

an apparatus body including a body side connector;

a removable unit to be removably inserted in the apparatus body in an insertion direction, the removable unit including a unit side connector configured to:

engage with the body side connector in conjunction with insertion of the removable unit into and from the apparatus body in the insertion direction; and disengage from the body side connector in conjunction with removal of the removable unit from the apparatus body in a removal direction;

a first holder configured to hold the body side connector and restrict the body side connector from moving in the insertion direction relative to the first holder;

a second holder configured to hold the first holder and restrict the first holder from moving in a direction different from the insertion direction and the removable direction; and a biasing member configured to press the first holder against the removable unit being in the apparatus body, wherein the removable unit is a fixing unit including a pair of rotators, the pair of rotators pressing against each other and forming a nip to fix a toner image on a recording medium.

8. The image forming apparatus of claim 7, wherein each of the body side connector and the unit side connector is a ready-made drawer connector.

9. The image forming apparatus of claim 7, wherein each of the body side connector and the unit side connector is a ready-made drawer connector.

10. The image forming apparatus of claim 9, wherein the removable unit is a fixing unit including a pair of rotators, the pair of rotators pressing against each other and forming a nip to fix a toner image on a recording medium.

11. The image forming apparatus of claim 7, wherein the removable unit is a fixing unit including a pair of rotators, the pair of rotators pressing against each other and forming a nip to fix a toner image on a recording medium.

* * * * *